US006312251B1

(12) United States Patent
Schmorleitz

(10) Patent No.: US 6,312,251 B1
(45) Date of Patent: Nov. 6, 2001

(54) LIQUID-FUEL VOTIVE LIGHT

(76) Inventor: Robert K. Schmorleitz, 2458 Catalina Ave., Vista, CA (US) 92085

( * ) Notice: Subject to any disclaimer, the term of this patent is extended or adjusted under 35 U.S.C. 154(b) by 0 days.

(21) Appl. No.: 09/699,006

(22) Filed: Oct. 28, 2000

(51) Int. Cl.[7] ..... F23D 3/02; F23D 3/18; F23D 3/24

(52) U.S. Cl. ..... 431/320; 431/321; 431/322; 431/324; 126/45

(58) Field of Search ..... 431/320, 321, 431/322, 324, 298, 120, 144, 145, 142; 126/45

(56) References Cited

U.S. PATENT DOCUMENTS 193,673 * 7/1877 Rhind ..... 431/323
1,991,773 * 2/1935 Sauer ..... 431/324
2,523,510 * 9/1950 Martin ..... 431/324
3,321,938 * 5/1967 Bureau .
4,494,926 * 1/1985 Riha .
4,728,286 * 3/1988 Olsen .
4,875,852 * 10/1989 Ferren .
5,127,825 * 7/1992 Tendrick, Sr. .
5,669,767 * 9/1997 Bureau et al. .

FOREIGN PATENT DOCUMENTS

696351 * 12/1930 (FR) ..... 431/321

* cited by examiner

*Primary Examiner*—Carl D. Price
(74) *Attorney, Agent, or Firm*—Charles C. Logan

(57) ABSTRACT

A specially-shaped wick holder 12, in conjunction with an irregularly-shaped hole 14 in a reservoir 10 provides cooling and liquid-flow properties not obtainable with previous liquid-fuel candles. A fuel replenishment process further enhances the oil-free external environment.

6 Claims, 3 Drawing Sheets

LIQUID-FUEL VOTIVE LIGHT

CROSS-REFERENCE TO RELATED APPLICATIONS

Not Applicable.

STATEMENT REGARDING FEDERALLY SPONSORED RESEARCH AND DEVELOPMENT

Not Applicable.

BACKGROUND

1. Field of Invention

This invention relates to liquid-fuel imitation candles, specifically to safe, efficient, cool-burning methods of supplying fuel to a decorative flame.

2. Description of Prior Art

Places of worship have long used candles as decoration, as symbols of departed souls, and as devices to solicit donations. More recently, oil-fired lamps have been used for the same purposes. Liquid fuels have been developed to burn cleanly, without noticeable odor, and without the wax residue characteristic of spent candles. Problems inherent in liquid-fueled imitation candles include heat build-up in the wick holder, and management of the return flow of fuel. Re-fueling processes, while straightforward, admit to fluid spills and resultant oily residues, as well as possible fire hazards.

SUMMARY

A specially-shaped wick holder, in conjunction with an irregularly-shaped refueling orifice, is capable of efficient heat dissipation and fluid return.

OBJECTS AND ADVANTAGES

The objects and advantages of the present invention are:

(a) To provide a liquid-cooled wick holder, which prevents heat damage to composition parts.

(b) To provide a fluid return path to compensate for capillary action in excess of that required to support a flame.

(c) To provide an easily refilled body and wick holder assembly.

DRAWING FIGURES

LIST OF REFERENCE NUMERALS

10—Reservoir-Body
12—Wick Holder
14—Regular or irregularly shaped hole
16—Semicircle (keyway)
18—Key
20—Bell-shaped or bulbous heat sink/fluid return shape
22—Collar
23—Undercut Bevel
24—Fiberglass Wick
26—Funnel

28—Functional Measuring Cup
30—Line
32—N. Paraffinic Hydrocarbon Oil
34—Tray or dish

DESCRIPTION-FIG. 1-PREFERRED EMBODIMENT

Figure 1:
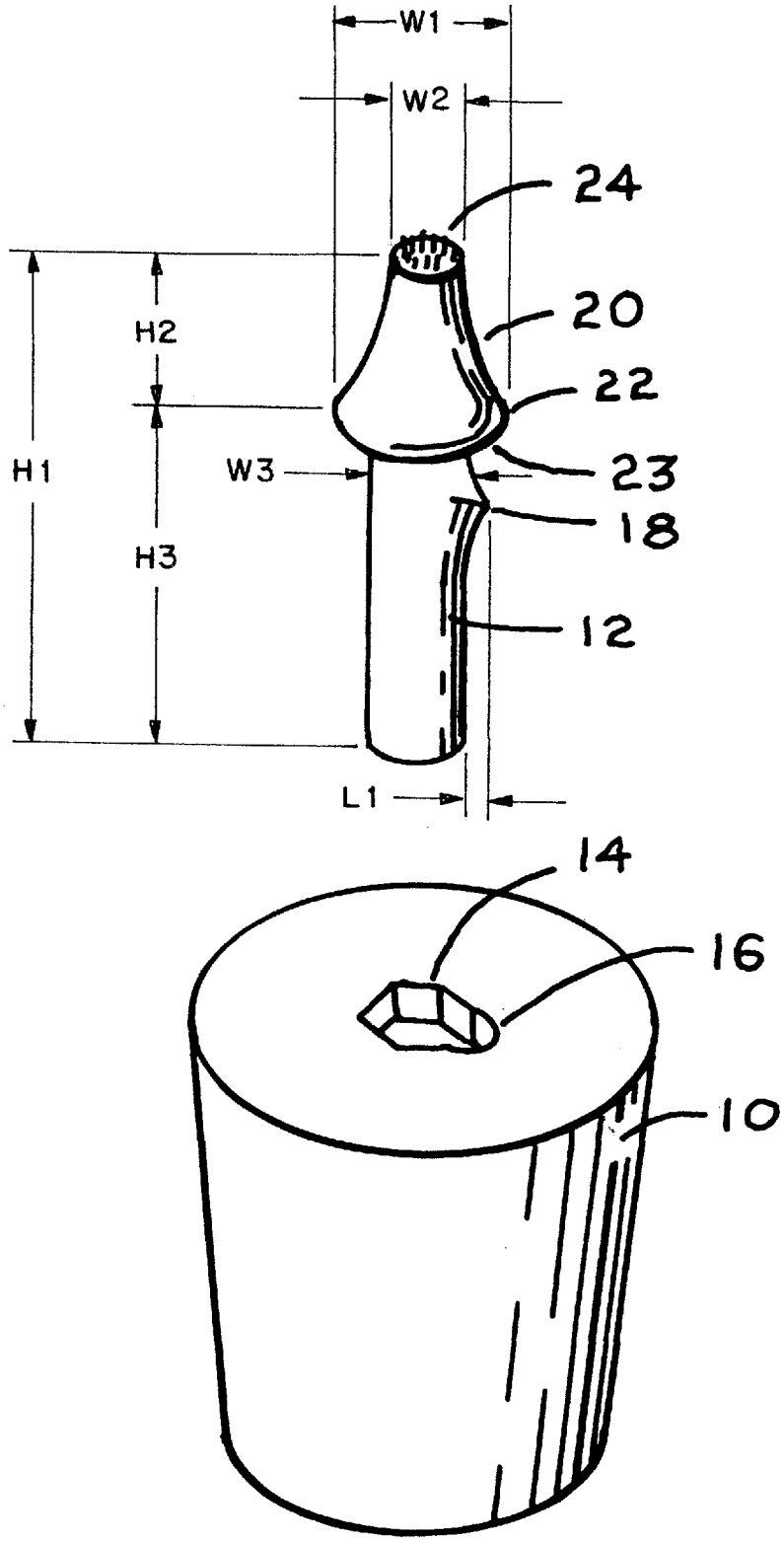
FIG. 1 illustrates the wick holder and body, and general shape of the heat-dissipating features of the wick holder.
Figure 2:
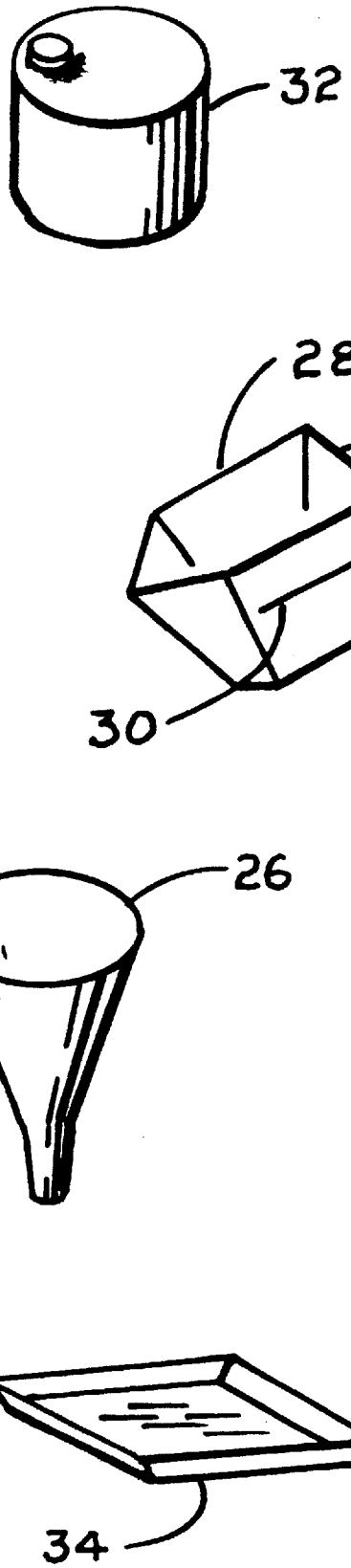
FIG. 2 shows the components for the fluid replenishment process.

A preferred embodiment of the Liquid Fuel Votive Light is illustrated in FIG. 1. A reservoir-body 10 of composite material is broached with a regular or an irregularly shaped hole or aperture 14 which is used to receive a wick holder 12 or to receive replenishment fuel. A keyway 16 in conjunction with a key 18 can be added to inhibit a tendency for inadvertent separation of body 10 and wick holder 12.

Wick holder 12 is comprised of a bell-shaped portion or bulbous heat sink portion 20, a collar 22, and an undercut bevel 23 and a shank portion 13. Wick holder 12 has a height H1. Bell-shaped portion 20 has a height H2 and shank portion 13 has a height H3. The top end of bell-shaped portion 20 has a width W2 and collar 22 has a width W1 at its bottom end. Shank portion 13 has a width W3. Key 18 extends outwardly a distance L1 from shank portion 13. A wick 24 extends through the central bore of wick holder 12. Body 10 can be made of plastic or composite material, such as nylon. Wick holder 12 is a metallic part, typically brass or a nickel alloy, and wick 24 can be any fibrous material, such as glass fiber.

The size and shape of wick holder 12 is important to the fluid flow and heat-conducting properties of this embodiment. A typical shape is 9.5 mm high from undercut bevel 23 to the top of wick holder 12. Collar 22 is 11.1 mm in diameter, with a 1.6 mm annular radius. Heat sink 20 is a gentle 11.2 mm radius flare from collar 22 to the top of wick holder 12.

Wick holder 12 is centrally bored with a 3.18 mm drill, then counter-bored 4.76 mm diameter from the bottom, up 25.4 mm. A light chamfer is machined in the bottom of the central bore.

DESCRIPTION-FIG. 2-PREFERRED EMBODIMENT

A functional measuring cup 28, a small funnel 26, and a container of fluid (typically N. Paraffinic Hydrocarbon oil) 32, complete the invention. Measuring cup 28 is specially marked with a line 30, and oil 32 is supplied in any convenient dispenser. A tray or dish 34 is a convenient item in which to place oil-soaked wick holder 12 when not inserted in reservoir 10.

ADDITIONAL EMBODIMENTS

The specific shape of wick holder 12 is optimum for heat dissipation and fuel return, but a generally bell-shaped or bulbous wick holder of similar shape, with or without key 18 and keyway 16, will perform satisfactorily. Different liquid fuel viscosities will require dimensional variations, while retaining the essential bell shape.

Key 18 is also of special shape, coming to a point 2.38 mm laterally beyond the cylindrical portion of wick holder 12, flared to tangency on both sides and the bottom. Key 18 is flat (horizontal) on top.

Wick 24 is conventional glass fiber, and extends beyond wick holder 12 at both top and bottom.

The exact shape of body 10 is an important part of the votive light, in that it is a compromise shape to accommodate a wide range of votive light receptacles. Other embodiments of this invention include body shapes to accommodate larger receptacles and multiple-wick configurations, where wick holder 12 and broached hole 14 are replicated on the top surface of body 10, where body 10 is of arbitrary or specified size and shape.

ADVANTAGES

The shape of wick holder 12 and regular or irregularly shaped hole 14 provide optimum heat dissipation and excess fluid ducting for a liquid fuel candle. Heat is transferred from wick holder 12 both to the surrounding atmosphere and to the returning fluid. Fluid is allowed back into reservoir 10 through irregularly shaped hole 14 efficiently, effectively eliminating the oily residue which normally plagues liquid-fueled illuminating devices.

OPERATION OF INVENTION

Figure 3:
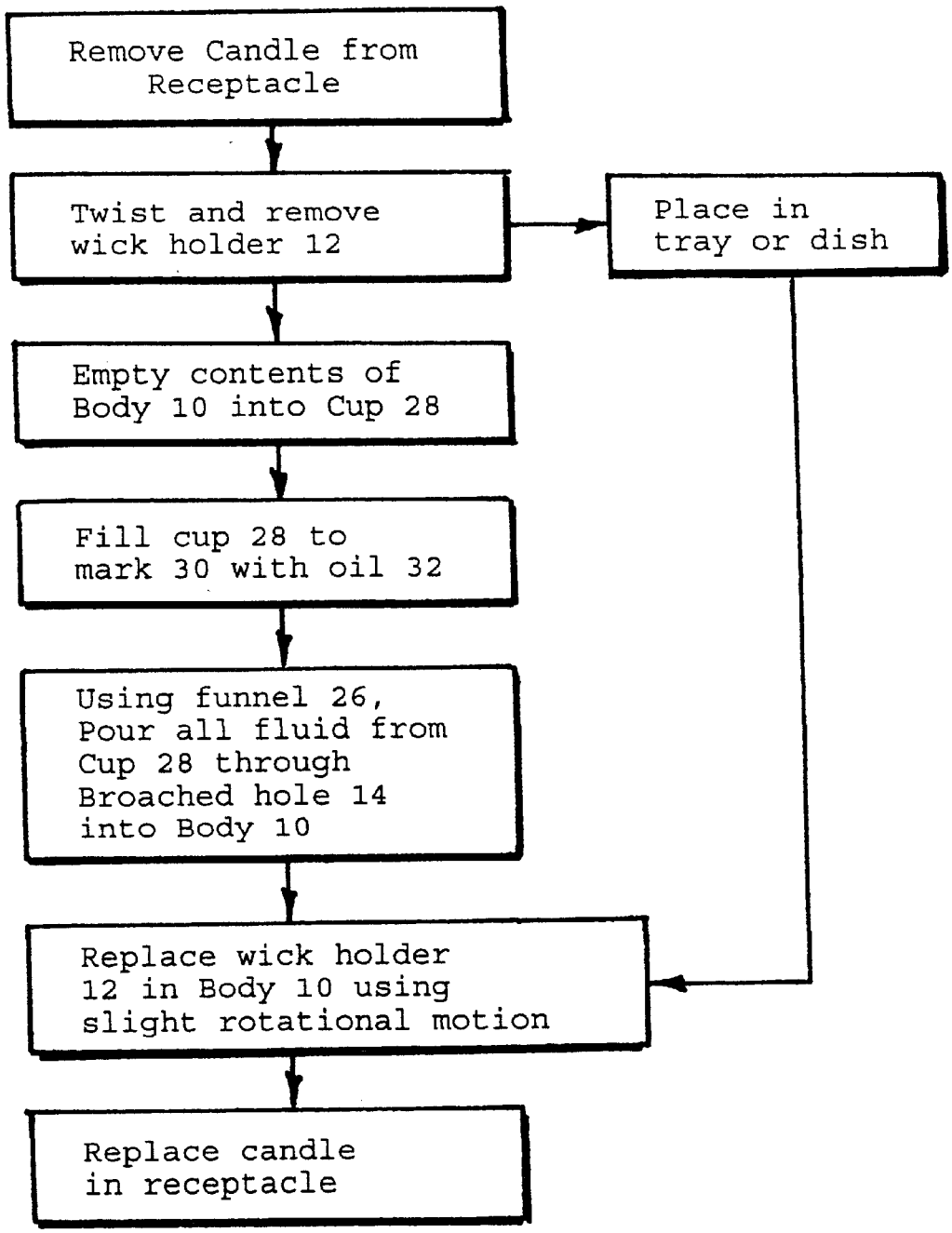
FIG. 3 is the replenishment process flow chart.

FIG. 3 illustrates the measured fluid injection process. Wick holder 12 is used to lift the votive light from its holder. A slight rotation of wick holder 12 aligns key 18 with keyway 16, allowing wick holder 12 to be removed and placed in a tray or similar receptacle 34.

Body 10 is then inverted over measuring cup 28, at which time all residual fluid is decanted. Measuring cup 28 is then filled to the mark with oil 32, and the measured volume of fuel in cup 28 is returned to body 10, with the aid of funnel 26.

Wick holder 12 is returned to body 10, and the shape of key 18 causes rapid alignment with only slight motion about the axis of wick holder 12. Once key 18 drops through keyway 16, further slight rotational motion allows the entire candle substitute to be lifted by wick holder 12, and it can be replaced in any holder.

Wick 24 can be ignited in any fashion desirable. Fluid is available through capillary action. There is no need for openings in the barrel of wick holder 12, since fluid has complete access at the bottom. Once ignited, excess fluid is available at the top of wick 24, and flows down return shape 20, cooling the top portion of wick holder 12. Fluid then flows over collar 22, remaining on the surface of wick holder 12 due to its unique shape, and surface tension properties of oil 32. Broached hole 14 and keyway 16 allow all fluid to return to the inside cavity of body 10. Contact points between wick holder 12 and broached hole 14 are extremely small, and in effect split the fluid flow, thereby avoiding return flow to the exterior of body 10.

Oil 32 is a clear, colorless liquid of excellent properties for this invention. It is considered safe enough for normal shipment (a "flammable" tag is not required),] and is low-hazard in terms of health, reaction with other materials, and stability. The shape of wick holder 12 and broached hole 14 is designed for this fuel, although it will work for any fuel of similar surface tension properties. The combination of oil 32, wick holder 12, and broached hole 14 is unique in that much experimental work was required to develop the resultant fuel flow and heat dissipation characteristics.

The inherent difficulty of inserting wick 24 through the central bore of wick holder 12 is overcome by using a loop of dental floss or other strong material of similar cross section, inserted through wick holder 12 from the top, then by threading wick 24 through the loop, bending wick 24 into a "U" shape, and pulling through. This simple procedure enables rapid insertion of wick 24, a task that is otherwise quite laborious.

CONCLUSION

Thus, the shape of wick holder 12 in conjunction with regular or irregular hole 14 yields a cool-burning, non-messy votive candle substitute. A simple refilling process assists in maintaining an oil-free exterior environment.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

I claim:

1. A liquid-fuel votive light comprising:

an upright oriented metallic tubular wick holder having a top end, a bottom end, an outer surface, an inner surface and a height HI; said wick holder having a bore hole that extends from said top end of said wick holder to said bottom end of said wick holder;

said wick holder having a generally bell-shaped portion and a shank portion; said bell-shaped portion having a top end having a width W2, a bottom end having a collar having a width W1 and W2 is less than W1; said bell-shaped portion having a height H2; said collar having an undercut bevel that extends to the top end of said shank portion; said shank portion having a width W3 and W3 is less than W1 and greater than W2;

a reservoir-body made of composite material having a top end; an aperture having a first predetermined horizontal configuration is formed in said top end for removably receiving said bottom end of said wick holder;

an elongated wick made of fibrous material having a top end that extends upwardly through said bore hole of said wick holder; and said top end of said shank portion having a second predetermined horizontal cross sectional configuration having a different shape from said first predetermined horizontal configuration in said top end of said reservoir-body that allows said shank portion to pass therethrough and also allows excess fluid fuel flowing down said outer surface of said bell-shaped portion of said wick holder to flow back into said reservoir-body.

2. A liquid-fuel votive light as recited in claim 1 further comprising locking means for removably securing said wick holder in said aperture in said top end of said reservoir-body.

3. A liquid-fuel votive light as recited in claim 2 wherein said locking means comprises said shank portion of said wick holder having a key member extending outwardly therefrom and said aperture in said top end of said reservoir-body having a key way slot in its perimeter that allows said key member to pass downwardly through said aperture following which only slight rotational motion of said wick holder locks said members together.

4. A liquid-fuel votive light as recited in claim 1 wherein said outer surface of said bell-shaped portion of said holder has a concave vertical contour.

5. A liquid-fuel votive light as recited in claim 4 wherein said concave vertical contour is generated from top to bottom about a radius substantially equal to 11.2 mm.

6. A liquid-fuel votive light as recited in claim 1 wherein said wick holder is machined from a solid piece of metal.

* * * * *